US005820234A

United States Patent [19]

Capwell et al.

[11] Patent Number: 5,820,234

[45] **Date of Patent: *Oct. 13, 1998**

[54] PROGRAMMABLE ELECTRONIC DESK LOCK

[75] Inventors: Robert Garold Capwell; Richard D. Webb, both of Kingsport, Tenn.

[73] Assignee: Hurd Corporation, Greeneville, Tenn.

[ * ] Notice: The terminal 5 months of this patent has been disclaimed

[21] Appl. No.: 384,870

[22] Filed: Feb. 7, 1995

[51] Int. Cl.[6] ..... E05B 65/46; E05B 53/00; E05C 9/10

[52] U.S. Cl. ..... 312/216; 312/217; 312/218; 70/278; 340/825.31

[58] Field of Search ..... 312/216, 217, 312/218, 221; 70/278; 340/825.31

[56] References Cited

U.S. PATENT DOCUMENTS

| | | | |
|---|---|---|---|
| 1,284,654 | 11/1918 | Graves | 312/217 |
| 1,716,274 | 6/1929 | Jones | 312/217 |
| 2,966,384 | 12/1960 | Bergman | 312/218 |
| 3,589,783 | 6/1971 | Studinski | 312/217 X |
| 3,854,310 | 12/1974 | Paull et al. . | |
| 4,062,056 | 12/1977 | Goodrich | 70/278 X |
| 4,672,826 | 6/1987 | Mombelli | 70/278 |
| 4,684,178 | 8/1987 | Craig . | |
| 4,744,021 | 5/1988 | Kristy | 70/278 X |
| 4,812,841 | 3/1989 | Chen | 70/278 X |
| 4,917,022 | 4/1990 | Ogasawara et al. | 70/278 X |
| 4,926,664 | 5/1990 | Gartner et al. | 70/278 X |
| 4,972,182 | 11/1990 | Novik et al. | 70/278 X |
| 4,986,099 | 1/1991 | Johnson et al. . | |
| 5,083,122 | 1/1992 | Clark | 70/278 X |
| 5,087,107 | 2/1992 | Fumanelli . | |
| 5,100,186 | 3/1992 | Nordvall . | |
| 5,172,967 | 12/1992 | Pipe | 312/217 |
| 5,184,491 | 2/1993 | Schittenbalm | 70/278 |
| 5,206,637 | 4/1993 | Warren . | |
| 5,225,825 | 7/1993 | Warren . | |
| 5,347,267 | 9/1994 | Murray | 340/825.31 |
| 5,406,274 | 4/1995 | Lambropoulos et al. | 340/825.31 X |
| 5,422,632 | 6/1995 | Bucholtz et al. | 340/825.31 |
| 5,422,634 | 6/1995 | Okubo | 340/825.31 X |

FOREIGN PATENT DOCUMENTS

| | | | |
|---|---|---|---|
| 153314 | 8/1985 | Japan | 312/216 |
| 1328192 | 8/1973 | United Kingdom | 312/216 |

*Primary Examiner*—Peter M. Cuomo
*Assistant Examiner*—Rodney B. White
*Attorney, Agent, or Firm*—Luedeka, Neely & Graham PC

[57] ABSTRACT

A desk locking mechanism operated by reversible D.C. electric motors and powered by dry cell batteries is controlled by a programmable microprocessor. A column of drawers are locked and unlocked simultaneously by a single, vertical axis motor having a threaded drive shaft to reciprocate a vertically guided locking bar. The microprocessor provides primary and secondary programmable operating codes in a multiplicity of digits with program states signified by distinctive LED flashing sequences.

30 Claims, 3 Drawing Sheets

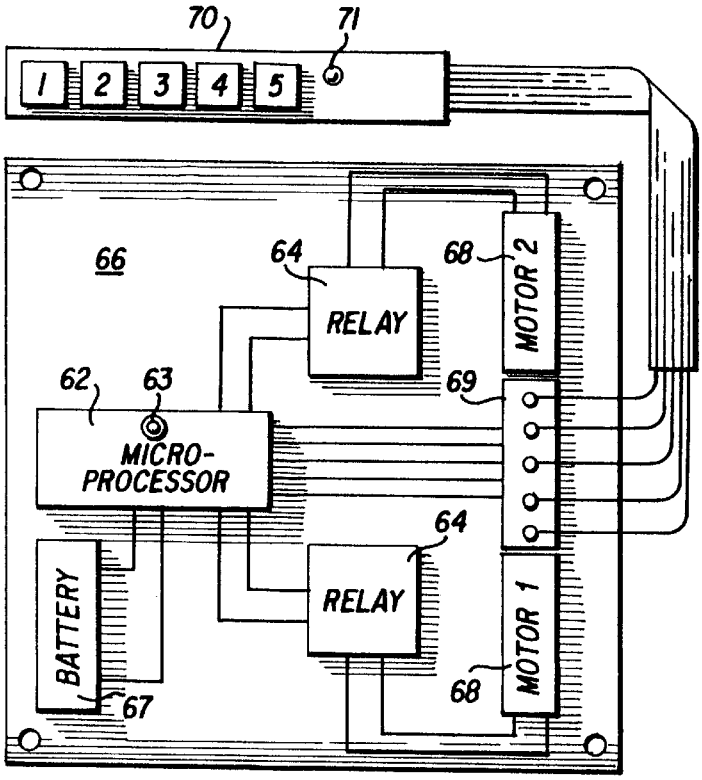
FIG. 2
FIG. 3
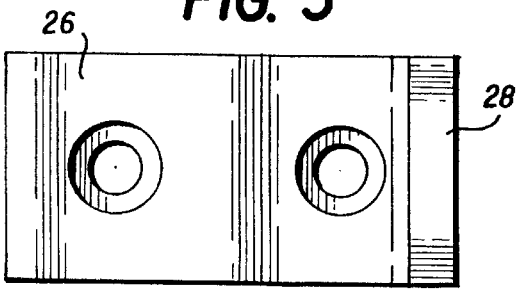
FIG. 4
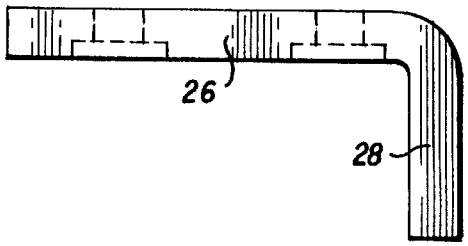
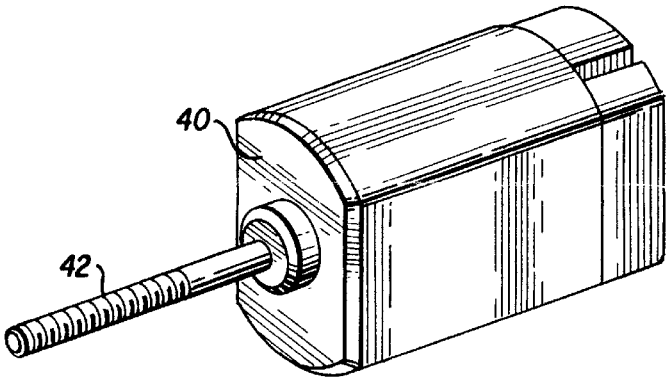
FIG. 5

PROGRAMMABLE ELECTRONIC DESK LOCK

BACKGROUND OF THE INVENTION

The present invention relates to office furniture locking devices and more particularly, to an electronically controlled locking mechanism for desks and filing cabinets.

Although desks and filing cabinets with electrically actuated locking means are known, an object of the present invention is to provide a programmable electronic locking system wherein the secured drawers are released for accessibility by digital key entry of one or more multiple digit codes. A first or primary un-lock code program is available subject to revision by a first security procedure. A plurality of secondary un-lock codes are also available that are subject to revision only by a second security procedure which includes the first unlock code whereby selected persons may enter the secured space having no access to first security procedure.

SUMMARY OF THE INVENTION

The present invention provides one or more vertical locking bars for each vertical column of horizontally displaced drawers. Each locking bar is functionally reciprocated by a respective, vertical axis screw thread reversibly rotated by a reversible drive d.c. motor.

Each vertically reciprocated locking bar is caged to oppose lateral or rotational movement about the locking bar axis. Such movement is imposed by drawer mounted abutment tabs set to physically engage a cantilevered tab element of the locking bar when in the lock position due to efforts to extract the drawer from the closed position.

An upper, lifting tab portion of a locking bar is apertured to receive the screw threaded motor shaft therethrough. Carried by the motor shaft thread lead under the locking bar lifting tab is a lifting nut. Rotation of the motor shaft causes the lifting nut to advance axially along the shaft in a direction depending on the shaft rotational direction.

The locking bar actuating motors are collectively energized, preferably, by dry cell batteries. Program control is asserted by a microprocessor that is keypad actuated. LED flashing sequences distinguish and identify respective programming modes.

In a first programming mode, a first, four digit sequence, for example, will unlock the cabinet. While in the first programming mode, a first command code will permit the entry of a plurality of second, lower level, four digit unlock codes by which the cabinet may be opened. However the second unlock codes provide no reprogramming access to the microprocessor. A third, one or two digit sequence will lock the cabinet from any open sequence.

BRIEF DESCRIPTION OF THE DRAWINGS

Other advantages of the present invention will be readily appreciated as the same becomes better understood with reference to the following description of the preferred embodiment when considered in connection with the accompanying drawings wherein:

FIG. 2 is an electrical power and control schematic for the present invention;

FIG. 3 is a front view of a drawer mounted abutment tab;

FIG. 4 is a side view of the drawer mounted abutment tab;

FIG. 5 is an isometric view of a motor suitable for the present invention;

DESCRIPTION OF THE PREFERRED EMBODIMENT

Figure 1:
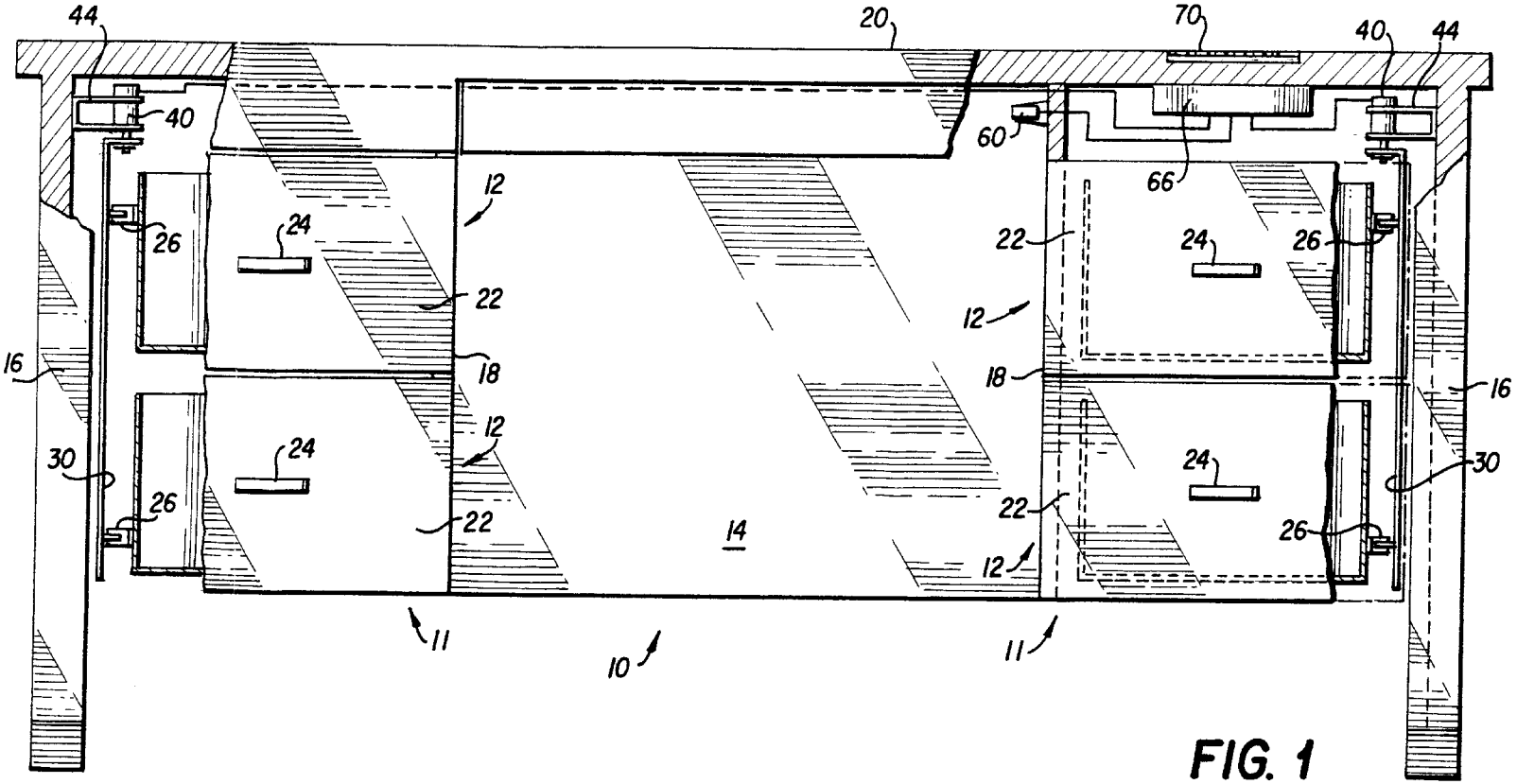
FIG. 1 is a front elevational view of a desk equipped with the present invention.

Relative to the drawings wherein like reference characters designate like or similar elements throughout the several figures of the drawings, an article of office furniture, such as a desk 10 shown by FIG. 1 or a filing cabinet not shown, usually includes one or more vertically stacked columns 11 of file drawers 12. Frequently, the drawers 12 are housed within cabinetry that provides a back wall 14 spanning between opposite end walls 16. The drawer cabinets are laterally enclosed by the desk end walls 16 and an internal knee space wall 18. The desk top 20 covers the top of the drawer column. Often, due to the structural strength of a drawer bottom, a separate drawer column bottom is omitted. The drawer fronts are enclosed by drawer faces 22 which support handles 24 for manual movement of the drawers.

Figure 11:
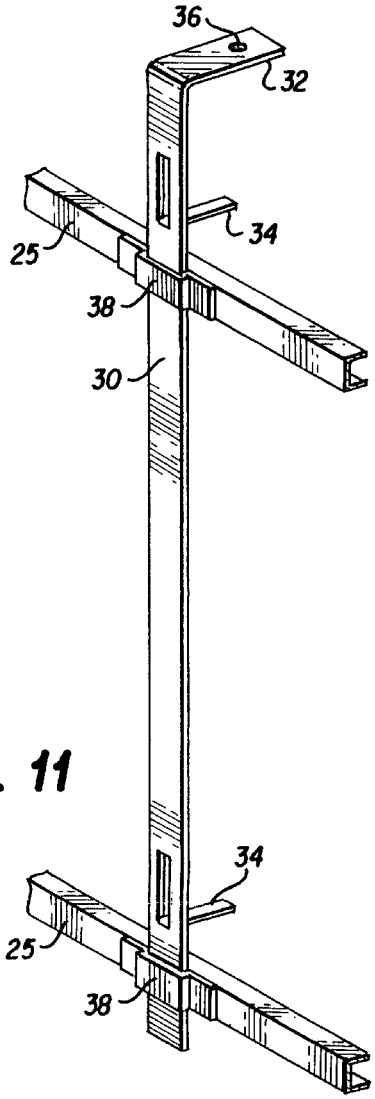
FIG. 11 is a pictorial view of the locking bar and drawer glide channels.

Usually, drawers of the type in point here are carried on rails or glides 25 shown in FIG. 11 as channel bars which are secured to the lateral walls 16 and 18 or to appropriate desk framing structure. The present invention also includes L-shaped abutment tabs 26 (FIGS. 3 and 4) secured to each outer drawer side with the tab blades 28 vertically aligned in a common plane when all drawers in a vertical cabinet are in the closed position.

Figure 8:
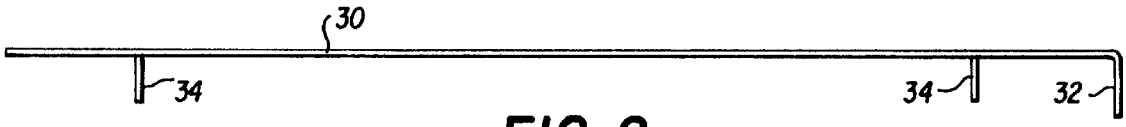
FIG. 8 is a side view of the locking bar.
Figure 9:
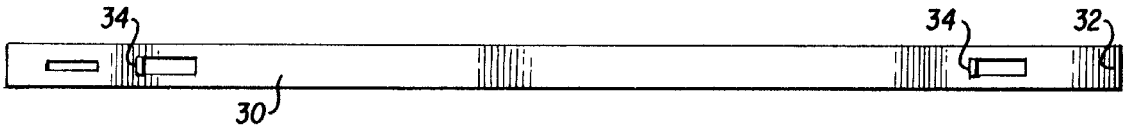
FIG. 9 is a front view of the locking bar.
Figure 10:
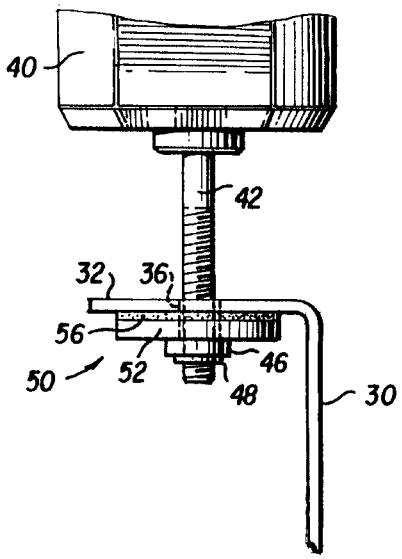
FIG. 10 is a detailed elevational view of the motor drive and locking bar assembly.

Proximate of the abutment tab plane but between the plane and the drawer cabinet front plane, a locking bar 30 is suspended from the shaft 42 of motor 40. Shown in detail by FIGS. 8, 9 and 11, the locking bar 30 is fabricated from a single strip of steel strapping, for example, with a hanger tab 32 formed at one end by a 90° bend. Below the hanger tab at vertical spacing corresponding to the vertical distance between the drawer abutment tabs 26, are bar tabs 34. These bar tabs 34 are formed by a punched segment of the bar body turned 90° out of the bar plane. As indicated by FIG. 10, the locking bar hanger tab 32 is provided with an aperture 26 to receive motor shaft 42 therethrough. FIG. 11 shows the bar 30 to be slideably caged in slots between the outer face of glides 25 and caging brackets 38 secured to each of the glides 25. These slots confine the bar exclusively to vertical sliding movement along the bar 30 length. Because of the rectangular section of the bar, the brackets 38 prevent any rotation of the bar about a vertical axis along the bar 30 length.

With respect to FIG. 1, the motor 40 is secured by a U-bracket 44 which holds the motor in a vertical axis position suitable for raising and lowering the locking bar 30. By such raising and lowering, the bar tabs 34 are horizontally aligned or misaligned with the drawer mounted abutment tabs 26. When in horizontal alignment, attempts to withdraw a protected drawer brings the drawer abutment blade 28 into conflict with the bar tab 34 thereby preventing further movement.

Figure 7:
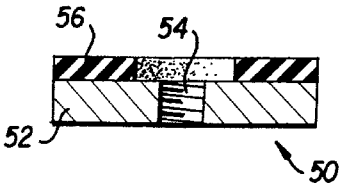
FIG. 7 is a sectional elevational view of the lifting nut.
Figure 6:
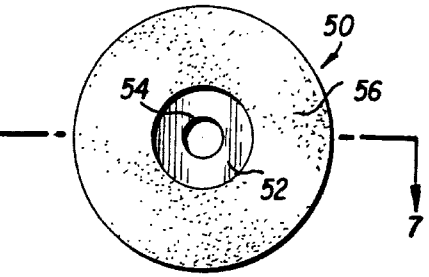
FIG. 6 is a plan view of the lifting nut.

As seen from FIGS. 5 and 10, the motor shaft 42 is threaded. The aperture 36 in the locking bar hanger tab 32 has a greater inside diameter than the thread crown diameter. Consequently, vertical translation of the locking bar 30 is achieved by the lifting nut 50 seen at FIGS. 6 and 7 as including a hardened collar piece 52 having a threaded aperture 54. Between the top surface of the collar piece 52 and the locking bar lifting tab 32 is a medium hard rubber pad 56. Motor shaft 42 has an end collar 46 secured axially by a ring clip 48. The rubber pad 56 to defeats the propensity of the nut 50 to rotate with the shaft 42 rather than axially translate along the shaft 42 as required.

Motor operation of the preferred embodiment is energized by a dry cell battery 60, for example, and controlled by a programmable control assembly such as the Model No. IEI 028300 manufactured by International Electronics, Inc. of Canton, Mass. This programmable control assembly includes an electronics mounting board 66 shown by FIG. 2 to structurally integrate a programmable microprocessor 62, polarity reversing relays 64 and connectors 67, 68 and 69 respective to the battery 60, motors 40 and a data entry key pad 70. This electronics mounting board 66 is preferably positioned structurally at some location within the desk assembly having restricted or inconvenient access such as beneath the desk top 20. Some alternative procedure may be provided for access to the electronics board 66 such as partial structural disassembly.

Manually entered program control data is directed to the microprocessor 62 from a membrane key pad 70 which is structurally secured at a conveniently accessible location such as the top 20. The presently preferred embodiment of the invention uses a key pad 70 with five keys and a light emitting diode (LED) 71.

The operational strategy of the preferred embodiment is to provide five distinct user codes, one of which is a master code, by which the desk may be unlocked. Desk locking is accomplished by a single code common to all users. The master code is used to access the microprocessor memory. In principle, up to five persons could have separate security access to the desk contents but only one person, the master code user, could change his own or the other four user codes.

Each user code is the product of four sequential key entry events. An entry event is produced by (1) pressing any one of the keys on the five key pad 70 or (2) by simultaneously pressing any two keys. For example, a representative user code may be 1-2-4-5. Another representative entry code may be 5-2/3-3/4-1.

The lock code used in common by all users may be served by only one key entry event such as a simultaneous pressing of the 1 and 5 keys (e.g. 1/5).

To unlock the desk with a recognized user code, 1-2-3-4, for example, the code is entered with the resultant flash of the LED 71 for each entry event. After the fourth entry event is pressed, LED 71 will remain on for 1 second. Thereafter, the LED will flash and the motors 40 will begin rotating in the direction consistent with raising the locking bar 30 from alignment. Such motor rotation will continue for 2 seconds, for example, or a programmed time sufficient for the locking bar tabs 34 to clear the drawer tab 26 horizontal displacement planes.

Each of the user codes will be distinguished in the memory by a digital address of 1 to 5. Address 1 is usually reserved for the master code which is initially set by the microprocessor manufacturer. To change the master code, the No. 1 key is held down until the LED 71 remains on. No. 1 key on the key pad is then released and the presently programmed master code, 1-2-3-4 for example, is entered. The LED will remain on for a few moments then begin to flash slowly which indicates the microprocessor to be in a programmable state. At this point, the new, 4 digit master code for the No. 1 user position, 4-3-2-1 for example, is entered with four sequential entry events. Resultantly, the LED will light steadily for a second then begin flashing rapidly. While the LED is rapidly flashing, an entry of the new No. 1 user code (master) of 4-3-2-1 is repeated. If at the end of the repeat entry of the new No. 1 user code the LED turns off, the new code will have replaced the old previous code. Conversely, if the LED remains on steadily, an error occurred in the procedure which must be repeated, starting with the press of any key on the pad to clear the microprocessor from the programmable mode.

To enter or revise the No. 2, 3 or other tertiary user codes, the foregoing procedure is repeated with the exception that the No. 2, 3 or other key on the pad corresponding to the address having a code change, is pressed initially until the LED remains on.

Erasure of a user code from the microprocessor memory follows a procedure that begins, as before, with pressing the desired user address key until the LED remains on. The address key is released and the master code entered. The LED will burn steadily for a second and start to flash slowly indicating a programming mode state. The desired user address key is pressed again and held until the LED burns steadily and the key is released. When the address key is released, the LED will begin to flash rapidly. The desired user number key is pressed again and held until the LED remains steadily on and the key released. If the LED turns off as the address key is released, the code has been erased. If not, there was an error in the procedure which is started over after pressing any key to clear the routine.

Other features of the microprocessor system control include a low battery indicator. If the battery 67 charge is insufficient to complete the motor function requested, the motor will not start the cycle and a prolonged illumination of the LED will be followed by flashing. Also, the motor control program will not respond to but one lock or unlock command in a cycle so that when the desk is locked, a subsequent or second command to lock is ignored. Only a valid unlock command will be recognized.

As a further security feature, the International Electronics Model IEI 028300 microprocessor includes an alternative reset procedure using a microswitch 63 physically located on the electronics mounting board 66. Consequently, physical access to the mounting board is required to engage the procedure. This alternative reset procedure is available to resolve the dilemma of a lost or unknown master code. In such case, all post-factory codes previously entered in the microprocessor memory may be erased and replaced by the original master code. Such procedure includes the simultaneous pressing of two, predetermined keys on the pad 70, 1 and 5 for example, and the reset microswitch 63 on the mounting board 66. Upon releasing these three buttons, the LED will flash, 3 times for example, indicating that the memory has been erased and the control program reset with the factory master code, 1, 2, 3, 4, for example.

The invention has been particularly shown and described with reference to a preferred embodiment thereof. It will be understood, therefore, by those skilled in the art that various changes in form and details may be made therein without departing from the spirit and scope of the invention. As my invention, therefore,

We claim:

1. A drawer cabinet enclosing a plurality of vertically aligned storage bins disposed for manual horizontal displacement between open and closed positions, each of said bins having respective laterally projecting abutment means for engaging locking bar means to secure a bin at a closed position, motor means for reciprocating said locking bar means between a locking position whereat horizontal displacement of a bin is prevented by engagement of said abutment means with said locking bar means and an open position whereat said abutment means avoids said locking bar means upon horizontal displacement of a bin, electric energy source means for energizing said motor means, a manual keypad for manually generating electrically transmitted digital sequence codes and programmable control means responsive to said keypad generated codes for selectively directing electric energy to said motor means, said control means being responsive to either first or second digital sequence codes for driving said locking bar means to said open position, a third digital code for driving said locking bar means to said locking position, and a fourth digital sequence code inclusive of said first code for changing the digit sequence of said second code.

2. An apparatus as described by claim 1 wherein said control means is conditioned by said first code as an antecedent for preparing said control means to be programmed for response to said second code.

3. An apparatus as described by claim 2 comprising a plurality of distinctive second codes operable for driving said locking bar means to said open position.

4. An apparatus as described by claim 2 wherein said control means comprises a programmable microprocessor responsive to a multiple digit, manual data entry keypad having signal means for reporting selected programming states.

5. An apparatus described by claim 4 wherein a first signal reports a first programmable configuration of said microprocessor to revise said second code.

6. An apparatus as described by claim 4 wherein a second signal reports a second programmable configuration of said microprocessor to confirm the revision of said second code.

7. An apparatus as described by claim 1 wherein said control means comprises a programmable microprocessor connected with a multiple digit, manual data entry keypad.

8. An apparatus as described by claim 7 wherein said control means further comprises switching means having an operational response to said microprocessor for connecting and disconnecting said energy source with said motor means.

9. An apparatus as described by claim 7 wherein said control further comprises switching means having an operational response to said microprocessor for connecting and disconnecting said energy source with said motor means.

10. An apparatus as described by claim 9 wherein the operational response of said switching means further comprises the selective reversal of electric energy polarity to said motor means.

11. An apparatus as described by claim 9 wherein the operational response of said switching means further comprises the selective reversal of electric energy polarity to said motor means.

12. An apparatus as described by claim 1 wherein said motor means comprises a threaded drive shaft having a lead nut threaded thereon, said locking bar means being axially reciprocated along said drive shaft by shaft rotation within said lead nut.

13. An apparatus as described by claim 1 wherein said locking bar means is supported by said lead nut.

14. An apparatus as described by claim 13 wherein said locking bar means is a singularly integral, elongated bar element having an apertured support tab projecting substantially normal to a length dimension of said bar for receiving said drive shaft therethrough and for cooperation with said lead nut to reciprocate said elongated bar element.

15. An apparatus as described by claim 14 having a plurality of locking tabs projecting laterally of the length of said bar element proximate of said bin abutment means.

16. A desk locking system for securing a vertical column of desk drawers disposed for manual horizontal displacement between open and closed positions, said drawers having laterally projecting abutment means; elongated locking bar means having a length dimension vertically disposed adjacent said drawer means proximate of said drawer abutment means; motor means for vertically reciprocating said locking bar means between a locked position and an open position, said drawer abutment means engaging said locking bar means in said locked position when horizontal drawer displacement is attempted; electric power source for energizing said motor means; manual keypad means for generating electrically transmitted digital sequence codes; and, programmable control means responsive to said keypad codes for selectively directing electric energy from said power source to said motor means; said motor means having a threaded shaft aligned substantially parallel with the length of said locking bar means in substantial suspension by one end thereof from said threaded shaft, said programmable control means being responsive to either first or second digital sequence codes for driving said locking bar means to said open position, a third digital code for driving said locking bar means to said locking position and a fourth digital sequence code inclusive of said first code for changing the digit sequence of said second code.

17. A locking system as described by claim 16 wherein said locking bar means is a singularly integral, elongated bar element having an apertured support tab projecting substantially normal to the bar length for receiving said threaded shaft therethrough, lead nut means threaded upon said shaft for cooperation with said support tab to reciprocate said bar element.

18. A locking system as described by claim 17 having a plurality of locking tabs projecting laterally of the length of said bar element in the proximity of said drawer abutment means for engagement of said abutment means when said locking bar is at said locked position.

19. A locking system as described by claim 16 wherein said control means comprises a programmable microprocessor connected with a multiple digit, manual data entry keypad.

20. A locking system as described by claim 19 wherein said control means includes program signal means for reporting selected states of microprocessor programmability.

21. A locking system as described by claim 19 wherein said microprocessor comprises a first program configuration responsive to a first digital code for driving said locking bar means to said open position and a second digital code for driving said bar means from said open position to said locked position.

22. A locking system as described by claim 21 wherein said microprocessor comprises a first reprogramming configuration for changing said first digital code.

23. A locking system as described by claim 22 wherein said microprocessor comprises a second program configuration responsive to a third digital code for driving said locking bar means to said open position.

24. A cabinet enclosure for at least one bin disposed for substantially horizontal displacement between open and closed positions, said cabinet having a locking mechanism for securing said bin at said closed position, said locking mechanism being driven by electric motor means, programmable control means for selectively directing electric energy to said motor means, said control means being responsive to either first or second digital sequence code for driving said locking bar means to said open position, a third multiple digital sequence code for driving said locking bar means to said locking position, and a fourth digital sequence code inclusive of said first code for changing the digit sequence of said second code and manual keypad means for transmitting digital sequence codes to said control means.

25. An apparatus as described by claim 24 wherein said control means is conditioned by said first code as an antecedent for preparing said control means to be programmed for response to said second code.

26. An apparatus as described by claim 25 comprising a plurality of distinctive second codes operable for driving said locking bar means to said open position.

27. An apparatus as described by claim 25 wherein said control means comprises a programmable microprocessor responsive to a multiple digit manual data entry keypad having signal means for reporting selected programming states.

28. An apparatus described by claim 27 wherein a first signal reports a first programmable configuration of said microprocessor to revise said second code.

29. An apparatus as described by claim 27 wherein a second signal reports a second programmable configuration of said microprocessor to confirm the revision of said second code.

30. An apparatus as described by claim 24 wherein said control means comprises a programmable microprocessor connected with a multiple digit, manual data entry keypad.

* * * * *